United States Patent [19]

Takahashi

[11] 4,265,158

[45] May 5, 1981

[54] ELECTRONIC MUSICAL INSTRUMENT

[76] Inventor: Shuichi Takahashi, 1-1-16, Takaidohigashi, Suginami-ku, Tokyo, Japan

[21] Appl. No.: 84,503

[22] Filed: Oct. 12, 1979

[30] Foreign Application Priority Data

| | | | |
|---|---|---|---|
| Feb. 9, 1979 | [JP] | Japan | 54-13293 |
| Mar. 15, 1979 | [JP] | Japan | 54-29431 |
| Mar. 20, 1979 | [JP] | Japan | 54-31723 |

[51] Int. Cl.[3] ..... G10H 1/12; G10H 5/00

[52] U.S. Cl. ..... 84/1.22; 84/1.19; 84/DIG. 9; 364/419; 364/724

[58] Field of Search ..... 84/1.01, 1.03, 1.11–1.13, 84/1.19–1.22, 1.24, 1.26, DIG. 9; 333/167; 364/419, 724

[56] References Cited

U.S. PATENT DOCUMENTS

| | | | |
|---|---|---|---|
| 3,515,792 | 6/1970 | Deutsch | 84/1.03 |
| 3,809,786 | 5/1974 | Deutsch | 84/1.01 |
| 3,809,789 | 5/1974 | Deutsch | 84/1.01 |
| 3,956,960 | 5/1976 | Deutsch | 84/1.19 |
| 4,000,675 | 1/1977 | Futamase et al. | 84/1.01 |
| 4,114,498 | 9/1978 | Chibana et al. | 84/1.19 |
| 4,173,915 | 11/1979 | Gross | 84/1.19 |
| 4,178,824 | 12/1979 | Aoki et al. | 84/1.19 |
| 4,185,529 | 1/1980 | Kitagawa | 84/1.01 |
| 4,192,210 | 3/1980 | Deutsch | 84/1.01 |
| 4,205,577 | 6/1980 | Deutsch | 84/1.21 |
| 4,211,138 | 7/1980 | Deutsch | 84/1.01 |
| 4,214,502 | 7/1980 | Holpuch et al. | 84/1.24 |
| 4,228,713 | 10/1980 | Gross | 84/1.19 |

*Primary Examiner*—S. J. Witkowski

*Attorney, Agent, or Firm*—Spencer & Kaye

[57] ABSTRACT

An elementary digital filter comprising an arithmetic logic unit with associated registers and timing circuits, simulates a current and a voltage in a corresponding elementary analog filter. The frequency response character of this elementary digital filter is changed when a coefficient used in the simulation or the sampling period used as the data renovation cycle of the simulation is changed. A digital filter circuit is composed of such an elementary digital filter or a combination of such elementary digital filters. A time function is passed through this composed digital filter circuit, and the output of the digital filter circuit is converted to an analog voltage to produce a musical tone. The tone quality of the produced musical tone is determined by the original waveform of the time function and the frequency response character of the composed digital filter circuit.

15 Claims, 19 Drawing Figures

ELECTRONIC MUSICAL INSTRUMENT

BACKGROUND OF THE INVENTION

The present invention relates to an electronic musical instrument, and more particularly, to an electronic musical instrument wherein a digital representation of a waveshape is generated and this digital representation is processed through digital circuits.

In recent years, the technology of digital circuits has progressed remarkably, resulting in the development of various digital technics for generating musical tones. For one example, in U.S. Pat. No. 3,515,792, there is disclosed an electronic musical instrument in which a waveshape is stored in the form of digital representations and is repetitiously read out at a selectable rate thereby producing a musical note.

But this method for producing a musical note has disadvantages in that the quality of the produced musical tone is fixed by the waveshape which is previously stored, and that, for different tone qualities, different memories must be provided for storing different waveshapes.

For another example, in U.S. Pat. No. 3,809,786, there is disclosed a musical instrument wherein a desired waveshape is synthesized by adding the fundamental frequency component and the harmonic components. But this method of synthesizing a tone waveshape has a disadvantage in that the circuit is complicated because each frequency component must be processed independently of the other frequency components.

On the other side, in heretofore known analog type electronic musical instruments, analog filters are used to produce desired tone qualities. And an important disadvantage of an analog filter is that the filter character can not be changed unless one or more of the component parts of the filter is changed. Although techniques for designing conventional digital filters are well known, it is not economical to replace the analog filters in the heretofore known analog type electronic musical instrument by the corresponding conventional digital filters designed by the heretofore known design techniques, because these conventional digital filters have complicated circuits and are expensive.

SUMMARY OF THE INVENTION

Therefore, an important object of this invention is to provide a low-cost digital filter circuit which can economically replace the corresponding analog filter used in an analog type electronic musical instrument. It will be easily understood that all of the filters used in an analog type electronic musical instrument can be expressed as an elementary analog filter or as a combination of elementary analog filters. In this invention, an elementary digital filter comprising an arithmetic logic unit with associated registers and timing circuits, simulates a current and a voltage in the corresponding elementary analog filter, and such an elementary digital filter or a combination of such elementary digital filters substitutes for the analog filter of an analog type electronic musical instrument.

Another object of this invention is to provide sufficient flexibility in changing the frequency response character of the elementary digital filter. The frequency response character of the elementary digital filter of this invention is changed when a coefficient used in the simulation or the sampling period used for the data renovation cycle in the simulation is changed.

Still another object of this invention is to provide a simple circuit for producing a digital representation of a periodic time function which is to be passed through an elementary digital filter or a combination of elementary digital filters. The waveform of the generated periodic time function and the frequency response character of the elementary digital filter or the combination of the elementary digital filters are the two main factors for determining the desired tone quality in this invention. These two main factors can be independently adjusted for jointly producing the desired tone quality, while the component frequencies of the produced tone are not influenced by the adjustment of the elementary digital filter or the combination of the elementary digital filters.

And thus, the general object of this invention is to reduce the manufacturing cost of an electronic musical instrument by replacing the analog circuits in an analog type electronic musical instrument with the corresponding digital circuits of this invention.

Other and further objects, features and advantages of the invention will appear more fully from the following description taken in connection with the accompanying drawings.

DESCRIPTION OF THE PREFERRED EMBODIMENTS

Figure 1:
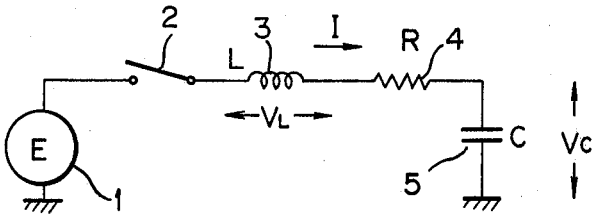
FIG. 1 shows an example of an elementary analog filter to be simulated in this invention.

Referring to FIG. 1, there is shown an example of an elementary analog filter to be simulated in this invention. A power supply 1 is connected, through a contact 2, to a serial connection of a coil 3, a resistor 4, and a capacitor 5. E denotes the voltage of the power supply 1, L denotes the inductance of the coil 3, R denotes the resistance of the resistor 4, C denotes the capacitance of the capacitance 5, I denotes the current through the serial connection, $V_L$ denotes the voltage induced in the coil 3, and $V_C$ denotes the voltage across the capacitor 5.

The performance of this circuit during a sufficiently short time interval Δt can be expressed by the equations;

$$C(\Delta V_C/\Delta t)=I \quad (1),$$

$$L(\Delta I/\Delta t)=V_L=(E-V_C-IR) \quad (2)$$

where $\Delta V_C$ is the increment of $V_C$ during Δt, and ΔI is the increment of I during Δt. The short time interval Δt is used as the sampling period, and when the initial values of $V_C$ and I are known, the instantaneous values of $V_C$ and I can be determined by adding the increments $\Delta V_C$ and ΔI to the values of $V_C$ and I at each sampling period Δt in accordance with the equations (1) and (2). And these data incremented calculations can be easily performed by digital circuits.

Figure 2:
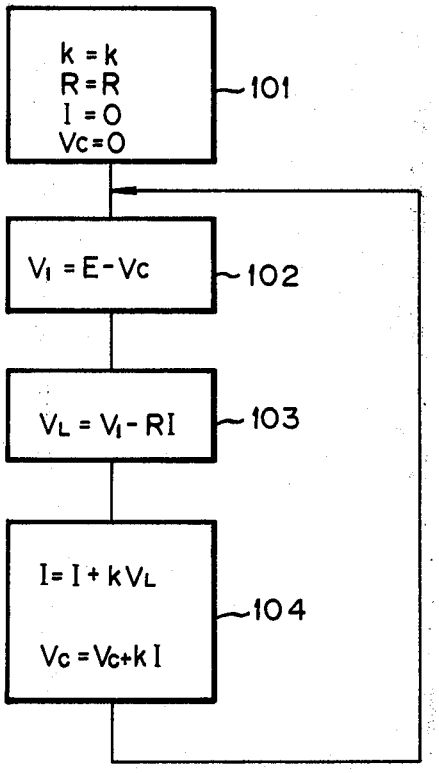
FIG. 2 shows an example of a flow chart illustrating the program steps for simulating the performance of the elementary analog filter shown in FIG. 1.

FIG. 2 shows an example of a flow chart illustrating the program steps for performing the data incremental calculation in accordance with the equations (1) and (2). In the step 101, the coefficients corresponding to L, R, C in these equations and the initial values for the variables $V_C$ and I are respectively determined. In the embodiment shown by FIG. 2, a particular case is assumed where $$\Delta t/L=\Delta t/C=k \quad (3)$$

It will be easily understood assumption will not injure the generality of the filter characteristic of the circuit shown in FIG. 1, as long as the ratio L/C which corresponds to the square of the surge impedance of the circuit, is not concerned. Thus a single coefficient k which corresponds to both L and C is determined in the step 101. And, in this embodiment, the initial values of the variable $V_C$ and I are set to zero. In the steps 102 and 103, the value $V_L$ in equation (2) is calculated. In step 102, a periodic time function E is received from a function generator as will be described in later paragraphs.

In the step 104, $\Delta V_C$ is calculated in accordance with equation (1) to increment the variable $V_C$, and ΔI is calculated in accordance with equation (2) to increment the variable I. The steps 102, 103, and 104 are completed once in each sampling period Δt, and thus, the voltage $V_C$ and the current I in FIG. 1 are simulated.

Before describing the circuit for performing the calculation shown in FIG. 2, a preferred embodiment of a time function E which simulates the voltage of the power supply 1 in FIG. 1, will be explained.

Figure 3:
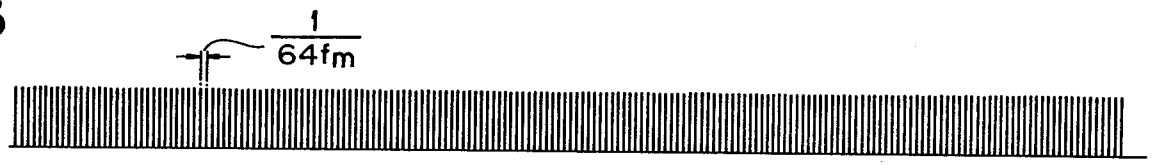
FIG. 3 shows an example of a clock pulse train which determines the sampling period in this invention.

FIG. 3 shows an example of a clock pulse train which determines the sampling period Δt, sampling period Δt being equal to the pulse-repetition period of the clock pulse train. In this embodiment, the sampling period Δt is determined in accordance with $$\Delta t=1/64f_m \quad (4)$$

where $f_m$ is a note frequency in the highest octave. There are twelve note frequencies in one octave, and these twelve note frequencies in the highest octave are 4,186 Hz, 4,435 Hz, 4,697 Hz, 4,978 Hz, 5,274 Hz, 5,588 Hz, 5,920 Hz, 6,272 Hz, 6,645 Hz, 7,040 Hz, 7,459 Hz, and 7,902 Hz for example. One of these twelve frequencies is selected as $f_m$ in accordance with the note to be produced. And the time function E in this embodiment is produced from the clock pulse train shown by FIG. 3.

Figure 4:
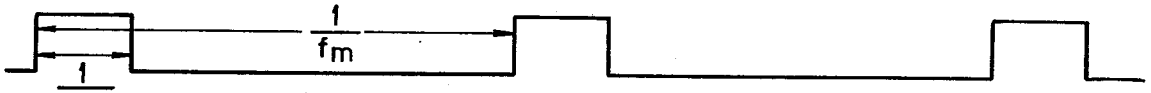
FIG. 4, FIG. 5, and FIG. 6 illustrate examples of periodic time functions generated in this invention.
Figure 5:
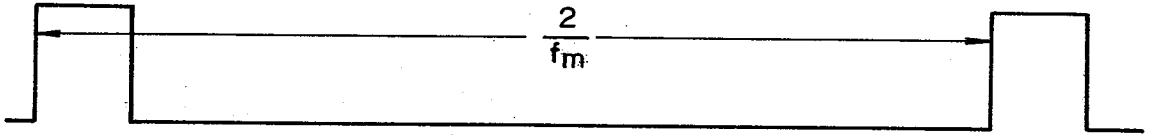
Figure 6:
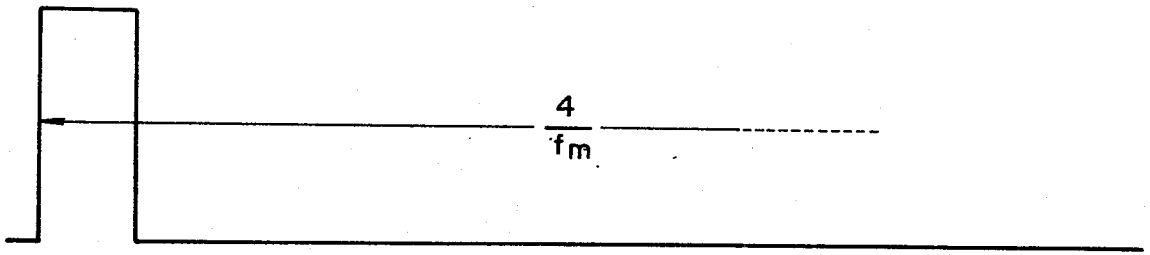

FIG. 4, FIG. 5, and FIG. 6 illustrate examples of the periodic time function E produced in one embodiment. It is assumed that there are seven (7) octaves in the electronic musical instrument concerned and that these octaves are numbered from one (1) to seven (7). Then, the fundamental frequency $f_O$ of a note in an octave number n is, $$f_O=f_m/2^{(7-n)} \quad (5)$$

where $f_m$ is a note frequency in the highest (n=7) octave as defined in the foregoing paragraph. In the embodiments shown by FIG. 4, FIG. 5, and FIG. 6, the periodic time function E has a rectangular waveform with its width maintained constant irrespective of the change of the octave. And this width is $1/4f_m$ in this embodiment. The recurrence frequency of the periodic time function E is $f_O$, and the amplitude of the rectangle is doubled when the octave of the corresponding tone is lowered by one step.

Figure 7:
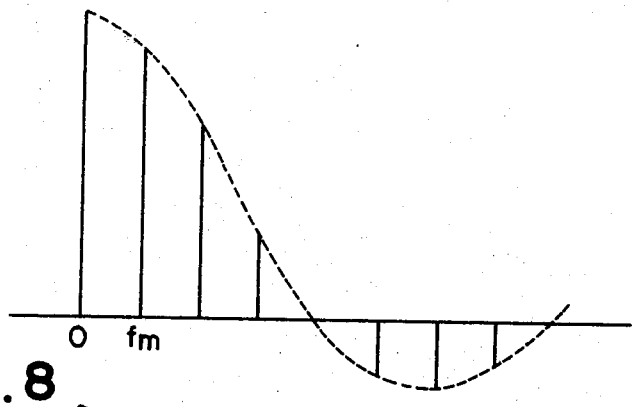
FIG. 7, FIG. 8, and FIG. 9 illustrate the spectrum distribution of the periodic time functions shown in FIG. 4, FIG. 5, and FIG. 6 respectively.
Figure 8:
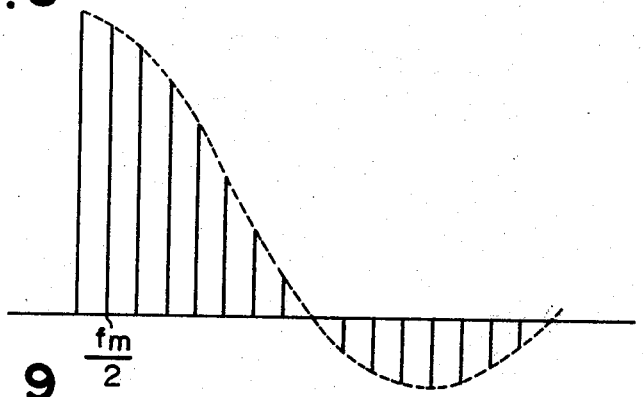
Figure 9:
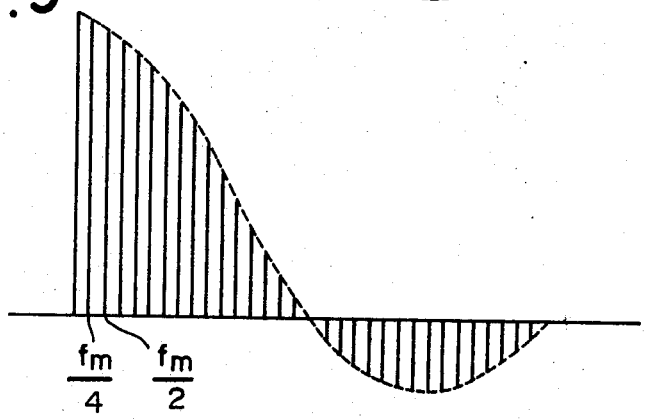

The spectrum distribution of these rectangular waveforms can be easily analysed by Fourier analysis, and FIG. 7, FIG. 8, and FIG. 9 illustrate the spectrum distributions of the periodic time functions shown in FIG. 4, FIG. 5, and FIG. 6 respectively.

The circuit shown in FIG. 1 composes a band pass filter for the input E, when $V_C$ or I is considered as the output. The tuning frequency $f_c$ of this band pass filter is, $$f_c=1/2\pi\sqrt{LC} \quad (6)$$

In order to keep the relation $$f_c=f_O \quad (7)$$

the coefficient k must be $$k=\Delta t/L=2\pi f_c\Delta t=(2\pi f_m/2^{(7-n)})\cdot(1/64f_m)=\pi/2^{(12-n)} \quad (8)$$

Equation (8) means that the coefficient k is to be changed when the octave number n is changed.

The coefficient R in FIG. 2, which represents the resistance R in FIG. 1, is determined from the requirement for the quality factor Q of this band pass filter. And in a preferred embodiment, a restriction will be imposed on the selection of the value of R, in which R is selected to be equal to $2^r$ where r is an arbitrary positive or negative integer including zero. Such a selection of R simplifies the multiplication in the step 103 of FIG. 2, and this restriction in the selection of R will be tolerable for most practical cases of a filter design in an electronic musical instrument.

Figure 10:
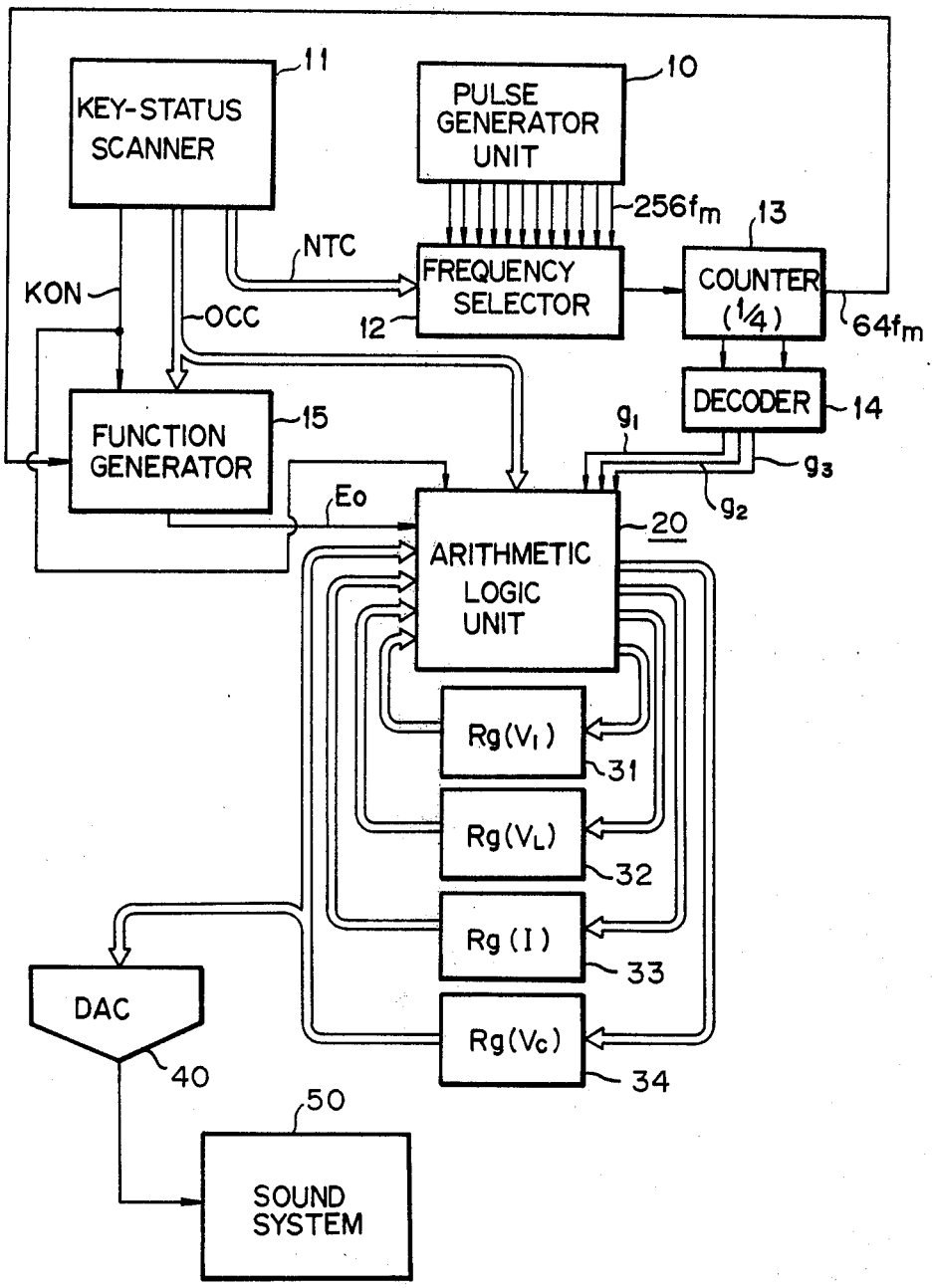
FIG. 10 shows a schematic block diagram of an embodiment of this invention.

Now referring to FIG. 10, there is shown a schematic block diagram of an embodiment of this invention. A key-status scanner 11 is provided to scan the state of all the key-switches on the instrument keyboard (not shown in the drawing) of the electronic musical instrument. And the key-status scanner 11 generates a key-on signal (hereafter denoted the KON signal) which indicates that a certain key-switch is in a closed state, together with the key-code which identifies the key associated with the corresponding KON signal. In this embodiment, a key-code is composed of an octave code (hereafter denoted by OCC) which represents the octave number n, and a note code (hereafter denoted by NTC) which represents a specified note out of the twelve notes in an octave. The OCC in this embodiment is a three-bit binary code, and the NTC is a four-bit binary code. The KON signal in this embodiment is a signal which is at logic "1" as long as the key-switch is closed.

A pulse generator unit 10 includes twelve oscillators which generate the twelve note frequencies at a frequency level of $256f_m$. At a frequency selector 12, one frequency is selected from the twelve frequencies in accordance with the NTC from the key-status scanner 11, and the selected frequency is frequency-divided by a two-state binary counter 13. The serial output of the counter 13, which has a frequency of $64f_m$ is transmitted to a function generator 15 to generate the periodic time function E.

Figure 11:
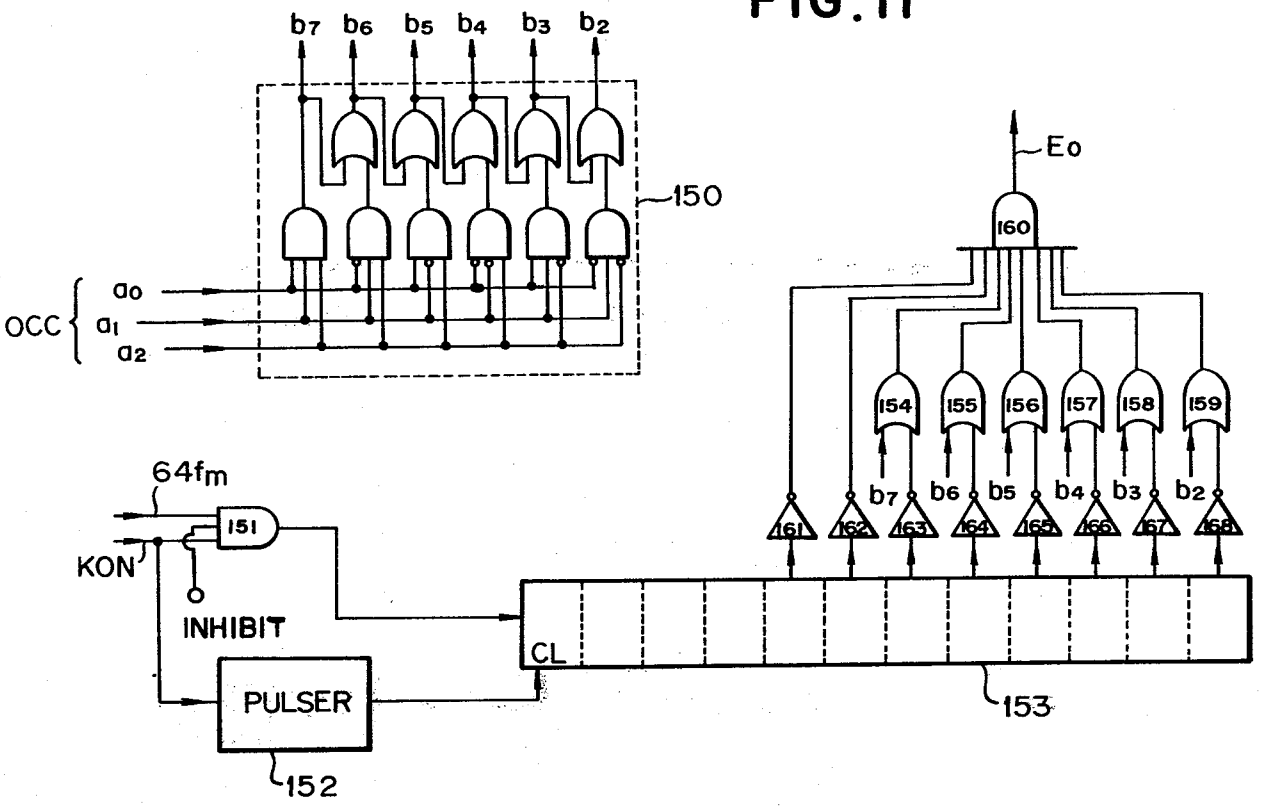
FIG. 11 shows a schematic block diagram of an embodiment of the function generator in FIG. 10.

FIG. 11 illustrates a schematic block diagram of am embodiment of the function generator 15 in FIG. 10. A block 150 surrounded by a broken line shows a decoder to decode the OCC into six (6) logic signals. The octave number n is expressed by the OCC as $n=a_O+2a_1+4a_2$. It will be easily understood that the signal $b_7$ becomes logic "1" when n=7, the signal $b_6$ becomes logic "1" when $n\geqq 6$, the signal $b_5$ becomes logic "1" when $n\geqq 5$, the signal $b_4$ becomes logic "1" when $n\geqq 4$, the signal $b_3$ becomes logic "1" when $n\geqq 3$, and the signal $b_2$ becomes logic "1" when $n\geqq 2$. And in FIG. 11, 151 and 160 indicate AND-gates, 154, 155, 156, 157, 158, and 159 indicate OR-gates, 161, 162, 163, 164, 165, 166, 167, and 168 indicate inverters, 152 is a pulser, and 153 is a pulse counter composed of twelve-stage cascaded binary counters. The pulse counter 153 has an input terminal and parallel output terminals as shown in FIG. 11. The reset-signal input terminal of the counter 153 is denoted by CL. The inverters 161–168 may be considered as included in the counter 153, since a conventional binary counter has an inverted signal output terminal. At the start point of the KON signal, the pusher 152 clears the counter 153. The clock pulse train having a frequency of $64f_m$ passes through the gate 151 during the KON signal and is counted by the counter 153. In accordance with the octave number n, unnecessary latter stages of the counter 153 are ignored through the gates 154–159 by the signals $b_7$–$b_2$. For example, when n=7, the signals $b_7$–$b_2$ are all at logic "1", and the output of the gate 160 will be at logic "1" when the output of the inverters 161 and 162 are simultaneously at logic "1". Therefore, the output of the gate 160 will be as shown by FIG. 4. And when n=6, the signals $b_6$–$b_2$ are at logic "1", and the output of the gate 160 will be at logic "1" when the output of the inverters 161, 162, and 163 are simultaneously at logic "1". And therefore, the output of the gate 160 will be as shown by FIG. 5, except that the amplitude of the rectangular waveform is unity. The necessary multiplication of the amplitude of the output from the gate 160 is performed in the arithmetic logic unit 20.

Again referring to FIG. 10, a decoder 14 is provided to decode the count phase of the counter 13 and generates three timing pulses $g_1$, $g_2$, and $g_3$, each having the same frequency of $64f_m$. It is assumed that these timing pulses have mutually different phases and come in the order of $g_1$, $g_2$, $g_3$. These timing pulses, the OCC, the KON signal, and the output of the gate 160 which is denoted by $E_O$ are transmitted to the arithmetic logic unit 20. In this particular embodiment, the coefficient k is determined by equation (8) from the octave number n, and therefore, a coefficient register for k is not necessary. A coefficient register for storing R in the step 101 in FIG. 2 is provided (not shown in the drawing) and the coefficient R is transmitted to the arithmetic logic unit 20. Four variable registers 31–34 are connected to the arithmetic logic unit 20. The register 31 which stores the variable $V_1$ is denoted by $Rg(V_1)$ register 31, the register 32 which stores the variable $V_L$ is denoted by the $Rg(V_L)$ register 32, the register 33 which stores the variable I is denoted by the Rg(I) register 33, and the register 34 which stores the variable $V_C$ is denoted by the $Rg(V_C)$ register 34.

In this specification, the variable $V_C$ is called a first variable, the $Rg(V_C)$ register 34 is called a first register, the variable I is called a second variable, and the Rg(I) register 33 is called a second register.

Figure 12:
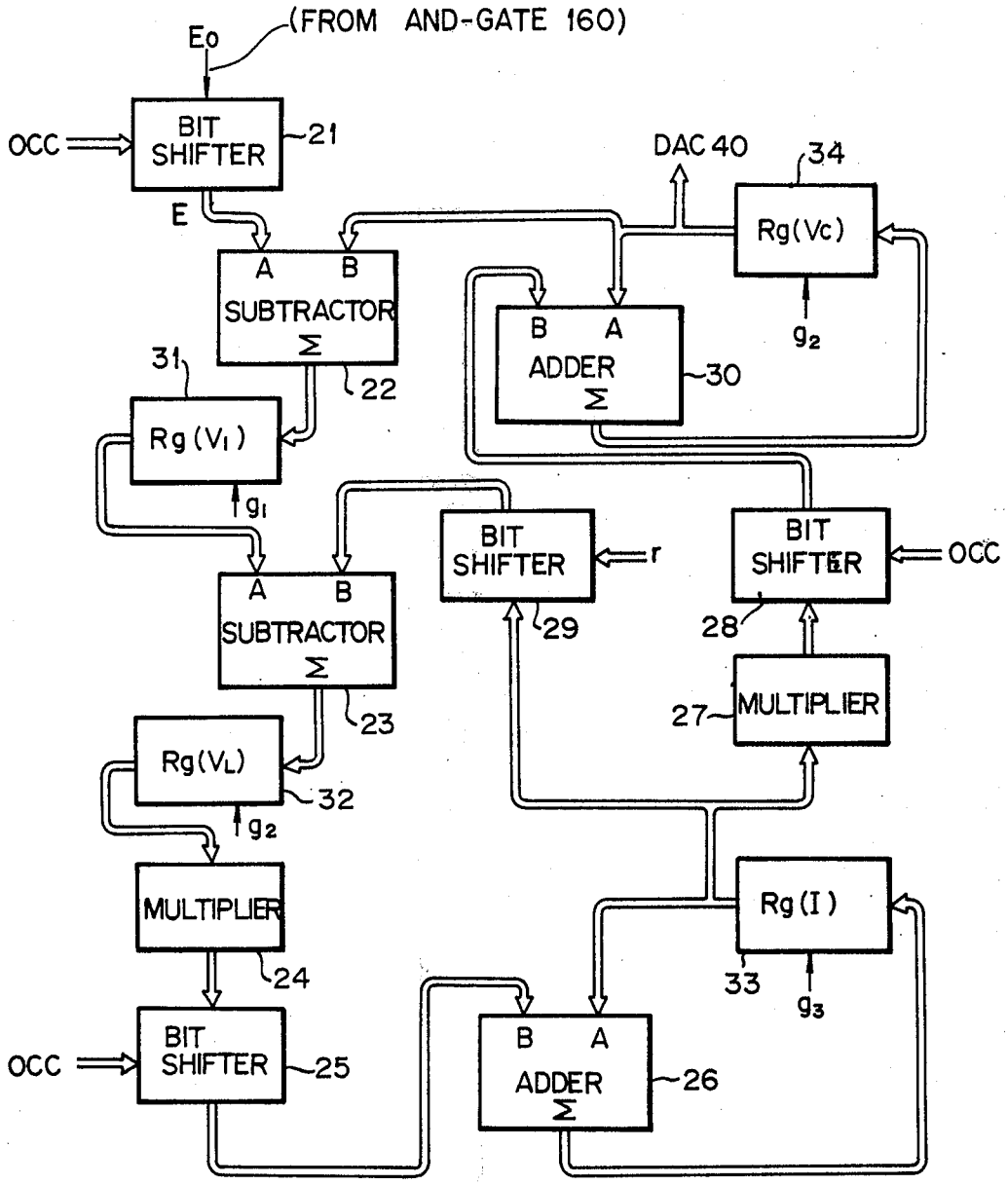
FIG. 12 shows a schematic block diagram of an embodiment of the arithmetic logic unit and the associated registers in FIG. 10.

FIG. 12 shows a schematic block diagram of an embodiment of the arithmetic logic unit 20 with the associated variable registers. In FIGS. 12, 21, 25, 28, and 29 are bit shifters, 22 and 23 are subtractors, 24 and 27 are $\pi$ multipliers, 26 and 30 are adders, and 31, 32, 33, 34 are the same registers shown in FIG. 10. In these registers as well as in the subtracters and adders, a negative number is expressed by the complement and a sign bit. And in the subtractors and adders, a subtraction is performed by complement addition, and the sign bits of the addend (the subtrahend) and the augend (the minuend) change the connection in the corresponding adder (subtractor). These conventional technics in the arithmetic logic unit are well known, and therefore, the changeover switching circuits for the adders and the subtractors are not shown in FIG. 12.

At the start of the KON signal, the $Rg(V_C)$ register 34 and the Rg(I) register 33 are reset as shown in the step 101 of FIG. 2. The output of the pulser 152 of FIG. 11 can be used to reset these registers, but the circuits are not shown in FIG. 12.

The bit shifter 21 multiplies the amplitude of the time function $E_O$ by a factor of $2^{(7-n)}$ where n is the octave number. It is clear that this multiplication can be performed by simply shifting the input bits in the bit shifter 21. The output E of the bit shifter 21 is $E=E_O2^{(7-n)}$. The subtractor 22 performs the subtraction $E-V_C$ and the resultant $V_1$ is loaded into the $Rg(V_1)$ register 31 at the timing of $g_1$. Thus, the step 102 of FIG. 2 is completed.

In this particular embodiment where $R=2^r$, the coefficient register for storing R (not shown in the drawing) stores a binary code for the integer r, and this code for r controls the bit shifter 29 to perform the multiplication of IR by shifting the bits from the output of the Rg(I) register 33 in an amount corresponding to the value of r. In order to maintain the ratio $2\pi f_O L/R$ constant through different octaves, the bit shifter 29 must be kept unchanged irrespective of the OCC, since L is inversely proportional to k by equation (3), $f_O$ is determined by equation (5), and the coefficient k is determined by equation (8).

The subtractor 23 performs the subtraction $V_1-RI$ shown by the step 103 of FIG. 2, and the resultant $V_L$ is loaded to the $Rg(V_L)$ register 32 at the timing of $g_2$. The multiplier 24 multiplies the contents of the $Rg(V_L)$ register 32 by a constant factor $\pi$. In order to perform this multiplication in a very short time, the multiplier 24 in this embodiment is composed of a logic circuit unit, and when a digital code representing an arbitrary number u is received at the input terminals of the logic circuit unit, a corresponding digital code representing $\pi u$ appears at the output terminals of the logic circuit unit. Thus, the output of the multiplier 24 represents $\pi V_L$, and since $kV_L=\pi V_L/2^{(12-n)}$ from equation (8), the necessary bit shift is performed in the bit shifter 25. The adder 26 performs the addition $I+kV_L$ shown in the step 104 of FIG. 2, and the resultant is loaded to the Rg(I) register 33 at the timing of $g_3$.

The multiplier 27 is the same as the multiplier 24, and the bit shifter 28 is the same as the bit shifter 25. And since the input of the multiplier 27 is the variable I, the output of the bit shifter 28 is kI. The adder 30 performs the addition $V_C+kI$ shown by the step 104 of FIG. 2, and the resultant is loaded to the $Rg(V_C)$ register 34 at the timing of $g_2$.

It has been assumed that the timing pulses come in the cyclic order of $g_1g_2$, $g_3$, $g_1$, . . . . Then, at the timing of $g_1$ when the $Rg(V_1)$ register 31 is loaded, the contents of the $Rg(V_C)$ register 34 is not yet incremented, and at the timing of $g_2$ when the $Rg(V_L)$ register 32 is loaded, the contents of the Rg(I) register 33 is not yet incremented. Therefore, a new value for the variable I is calculated from the old values of I, $V_C$, and E in the immediately preceding sampling period. And at the timing of $g_2$ when the $Rg(V_C)$ register 34 is loaded, the contents of the Rg(I) register 33 is not yet incremented, and therefore, a new value for the variable $V_C$ is calculated from the old values of $V_C$ and I in the immediately preceding sampling period.

The subtractor 22 must have a bit length which covers the whole variable bit position in the output of the bit shifter 21. The $Rg(V_1)$ register 31 must have a bit length which can receive the output of the subtractor 22. At the input of the subtractor 23, unnecessary lower bits of the output of the bit shifter 29 are omitted, since the omission will not be integrated to cause an appreciable error. The adder 26 must have a bit length which covers the whole variable bit range in the output of the bit shifter 25, and the Rg(I) register 33 must have a bit length which can receive the output of the adder 26. At the input of the bit shifter 29 and at the input of the multiplier 27, unnecessary lower bits in the output of the Rg(I) register 33 are omitted. The adder 30 must have a bit length which covers the whole variable bit range in the output of the bit shifter 28, and the $Rg(V_C)$ register 34 must have a bit length which can receive the output of the adder 30. At the input of the subtractor 22 and at the input of the DAC 40 (DAC 40 will be described in the following paragraph), unnecessary lower bits in the output of the $Rg(V_C)$ register 34 are omitted.

Returning to FIG. 10, the contents of the $Rg(V_C)$ register 34 is converted to an analog voltage by a digital to analog converter (hereinafter called DAC) and the output voltage from the DAC 40 is converted to a musical sound in a sound system 50. Since the DAC 40 and the sound system 50 are well known, no further description of these parts is necessary.

To this point, a particular embodiment of an elementary digital filter corresponding to an elementary analog filter has been described. The versatility of the digital circuits of this invention will be well understood when the analog circuit of FIG. 1 is compared to the digital circuit of FIG. 10. A total of $12\times7=84$ different filter circuits, each circuit being composed as shown in FIG. 1 would be necessary to cover the seven (7) octave range by an analog system. The digital circuit shown by FIG. 10 can cover the whole frequency range determined by the OCC and the NTC without changing any of the circuit components. Moreover, the tuning frequency $f_c$ of the elementary digital filter is automatically tuned to the fundamental frequency $f_O$ of the input periodic time function E when the coefficient k is determined in accordance with equation (8), and the quality factor Q of the resonance can be easily changed by changing the amount of bit shift in the bit shifter 29.

Further, it must be noted that the elementary digital filter shown in FIG. 12 also simulates the transient response of the corresponding elementary analog filter shown in FIG. 1. The transient response of the circuit of FIG. 1 for the input time function E can be easily determined by solving the relevant differential equation. In the general form of the transient response, there are a rising transient period, a stationary period, and a decaying transient period. The rising transient period begins at the closure of the contact 2, and the amplitude of the filter output increases as the number of repetitions of the input cycle of the periodic time function increases. Then the amplitude of the filter output becomes saturated and it will be said that the rising transient period has changed to the stationary period which lasts as long as the contact 2 is closed. The decaying transient period begins with the opening of the contact 2, and the amplitude of the filter output gradually decays. It is obvious that the waveshapes in the rising and the decaying transient periods can be used as the attack and the decay waveforms of the tone to be generated. And in this invention, the transient response in the rising transient period and the decaying transient period can be easily changed by changing the amount of the bit shift in the bit shifter 29 during the KON signal and at the end of the KON signal. As will be described in later paragraphs, the tuning frequency $f_c$ of this elementary digital filter can be easily shifted from the fundamental frequency $f_o$ of the input periodic time function E, and this frequency shift can also change the transient response in the rising transient period and the decaying transient period.

Figure 13:
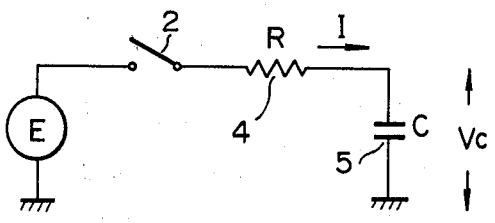
FIG. 13 shows another example of an elementary analog filter to be simulated in this invention.

In connection with another elementary analog filter, another elementary digital filter of this invention will be described. An elementary analog filter means, in this specification, a filter which is composed of not more than a single coil, a single capacitor, and a single resistor. FIG. 13 is a circuit diagram illustrating another elementary analog filter to be simulated in this invention, and all the notations in FIG. 13 are the same as those used in FIG. 1. The performance of this circuit during a sampling period $\Delta t$ can be expressed by the equation $$C(\Delta V_C/\Delta t)=I=(1/R)(E-V_C) \tag{9}$$

The notations in equation (9) are the same as those used in equations (1) and (2).

Figure 14:
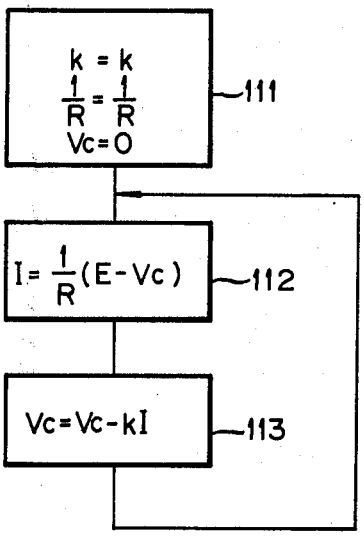
FIG. 14 shows an example of a flow chart illustrating the program steps for simulating the performance of the elementary analog filter shown in FIG. 13.

FIG. 14 shows an example of a flow chart illustrating the program steps for performing the data renovation calculations in accordance with equation (9).

Figure 15:
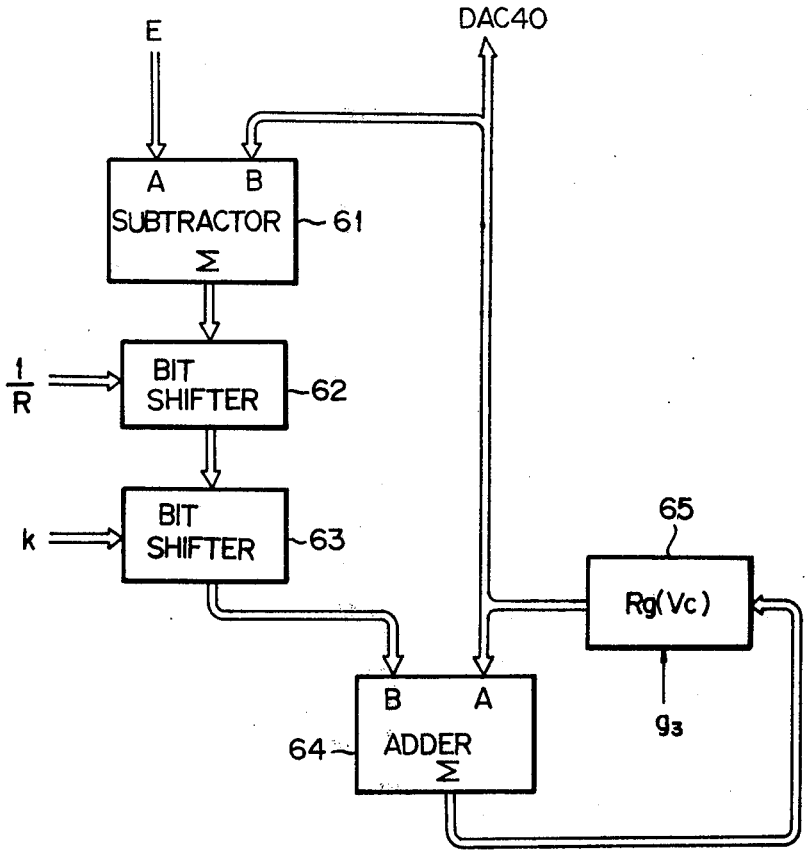
FIG. 15 shows a schematic block diagram of an embodiment of the arithmetic logic unit and the associated registers to perform the program steps of FIG. 14.

FIG. 15 shows a schematic block diagram of an embodiment of the arithmetic logic unit and the associated registers to perform the program steps shown in FIG.

14. The subtraction $E-V_C$ is performed by a subtractor 61, and the output of the subtractor 61 is multiplied by 1/R in a bit shifter 62. The output of the bit shifter 62 which represents the variable I in the program step 112 is multiplied by k in a bit shifter 63. The coefficient k in this embodiment is determined by $\Delta t/C$ (refer to equation (3)), and the time constant RC in the circuit of FIG. 13 is represented by $RC=R\Delta t/k$. An adder 64 performs the addition $V_C+kI$, and the resultant is loaded to the $Rg(V_C)$ register 65 at the timing of $g_3$.

The adder 64 must have a bit length which can receive the output of the bit shifter 63, and the $Rg(V_C)$ register 65 must have a bit length which can receive the resultant of the adder 64. And at the input of the subtractor 61 and the DAC 40, unnecessary lower bits of the output of the $Rg(V_C)$ register 65 are omitted.

As is clear from the corresponding analog circuit of FIG. 13, the elementary digital filter of FIG. 15 becomes an integrator when the output is taken from the contents of the $Rg(V_C)$ register 65, and becomes a differentiator when the output is taken from the output of the bit shifter 62.

Two different types of elementary digital filters have been described in connection with FIG. 12 and FIG. 15. It will be clear to a person versed in this technological field that an analog filter used in an analog type electronic musical instrument can be simulated by one of these elementary digital filters or by a combination of these elementary digital filters. When two elementary digital filters are to be cascade-connected, the output of one elementary digital filter is received as the periodic time function E for the other elementary digital filter. When two elementary digital filters are to be run in parallel, the two elementary digital filters receive a common periodic time function E and the two output are summed before the input to the DAC 40.

Furthermore, it is easy to compose a polyphonic musical instrument using the circuits of this invention. For a polyphonic musical instrument, a necessary number of waveshape generator units is provided, each such unit comprising an arithmetic logic unit 20 with the associated registers, a counter 13, a decoder 14, and a function generator 15, and the busy or idle (not busy) state of each waveshape generator unit is reported to a key-assigner which includes a pulse generator unit 10 and a necessary number of frequency selectors 12. When a newly closed key is found by the key-status scanner 11, the key-assigner assigns one of the idle (not busy) waveshape generator unit to this newly closed key and transmits the corresponding KON signal, the OCC, and the $256f_m$ pulse selected by the corresponding NTC to the assigned waveshape generator unit. The assigned waveshape generator unit produces a digital representation of a waveshape, and the output of all these waveshape generator units are summed before the input to a DAC 40. Or a DAC 40 may be provided for each waveshape generator unit, and the analog output of these DACs may be mixed before the input to the sound system 50.

So far, this invention has been described on a preferred embodiment. The minor modifications of the described embodiment will be explained in the following paragraphs.

In the particular embodiment described in connection with FIG. 4–9, it is assumed that a musical tone is generated from the lowest alternating-current component included in the periodic time function E; for example, a tone of fundamental frequency $f_o=(f_m/2)$ (refer to FIG. 8) is generated from the periodic time function shown by FIG. 5. But the spectrum distribution shown by FIG. 9 also includes the same frequency component of $f_m/2$ at approximately the same intensity level as that included in the spectrum distribution shown by FIG. 8; and therefore, the waveform shown by FIG. 6 may also be used as the time function E for generating a musical tone having a frequency $f_o=f_m/2$. When the waveform shown by FIG. 6 is used as the periodic time function E for generating a musical tone having a frequency $f_o=f_m/2$, such frequency components as $f_o/2$, $3f_o/2$, $5f_o/2$, $7f_o/2$, are also included in the output of the digital filter, and, in some cases, these frequency components are desirable for a tone quality to be produced.

In the particular embodiment described, the coefficient k is determined in accordance with equation (3). But it is obvious that there are two coefficients $$k_L=\Delta t/L \tag{31}$$

and $$k_C=\Delta t/C \tag{32}$$

for a general application. In this specification, the coefficient $k_C$ is called a first coefficient, the coefficient $k_L$ is called a second coefficient, and the coefficient R is called a third coefficient.

And in the particular embodiment described, the sampling period $\Delta t$ is maintained constant irrespective of the change of the octave number n while the coefficient k is changed in accordance with equation (8). In some other embodiments, however, the sampling period $\Delta t$ is doubled when the octave number n is reduced by one, while the coefficient k is maintained constant irrespective of the change of the octave number n.

Further, in the particular embodiment, the relation of equation (7) is maintained in which the tuning frequency $f_c$ of the digital filter is coincident with the tone frequency $f_o$. But in general, the ratio $f_c/f_o$ may be an arbitrary value in the vicinity of unity. The ratio $f_c/f_o$ affects the attenuation of the $f_o$ component, and will have no substantial effect when the Q of the tuning circuit is not extremely high and the ratio $f_c/f_o$ is in the vicinity of unity. For one numerical example, when $$k_L=\Delta t/L=4/2^{(12-n)} \tag{311}$$

$$k_C=\Delta t/L=2/2^{(12-n)} \tag{321}$$

$$\Delta t=1/64f_m \tag{4}$$

and R=0.5, the tuning frequency $f_c$ of the digital filter is $f_c=1/2\ \pi\sqrt{LC}=0.9\ f_o$ where $$f_o=f_m/2^{(7-n)} \tag{5}$$

the series impedance $$Z=\sqrt{R^2+(2\pi fL-\frac{1}{2\pi fC})^2}$$

is 0.52 for the frequency $f_o$ and is 0.5 for the tuning frequency $f_c$. When the coefficient $k_L$ and $k_C$ are determined in accordance with equations (311) and (321), the multipliers 24 and 27 in FIG. 12 can be eliminated.

In order to produce a muscial effect in some natural musical instruments the frequency $f_{o,n+1}$ of a note in an octave number n+1 is tuned to $$f_{o,n+1}=2f_{O,n}+\epsilon_n \quad (51)$$

where $f_{O,n}$ is the same note frequency in an octave number n and $\epsilon_n$ is a small positive number. And it has been difficult for heretofore known electronic musical instruments to simulate tuning shown by equation (51). In this invention, the condition of equation (51) is easily achieved by a minor modification of the function generator shown by FIG. 11. For example, another input is provided for the gate 151 to inhibit passage of the clock pulse of frequency 64 $f_m$ for a duration determined by the octave number n at a predetermined count phase of the counter 153. Thus, the harmonic relation of equation (5) is changed to a relation expressed by $$f_{o,n}+1=2f_{o,n}+\epsilon_n \quad (52)$$

where $\Delta f_n$ is a small positive number determined by the octave number n. It is clear that equation (52) is equivalent to equation (51). And since the tuning frequency $f_c$ of the digital filter is determined by $\Delta t$, the ratio $f_c/f_o$ is generally different from unity when the tone frequency $f_o$ is determined by equation (52). But this discrepancy of $f_c/f_o$ from unity will have no appreciable effect on the output waveshape of the digital filter.

It has been described that the coefficients k, $k_C$, $k_L$, and R are stored in coefficient registers. It is very easy to change these coefficients during the KON signal and/or at the end of the KON signal. For example, when the third coefficient R is increased at the end of the KON signal, the decay waveform of the generated tone will be more quickly damped. For another example, when the coefficients $k_L$ and $k_C$ are maintained in accordance with equations (311) and (321) during a KON signal, and at the end of the KON signal the coefficient $k_C$ is changed to a new value determined by $$k_C=4/2^{(12-n)} \quad (322)$$

both the tuning frequency $f_c$ and the quality factor Q of the digital filter is changed in the decaying transient period.

Figure 16:
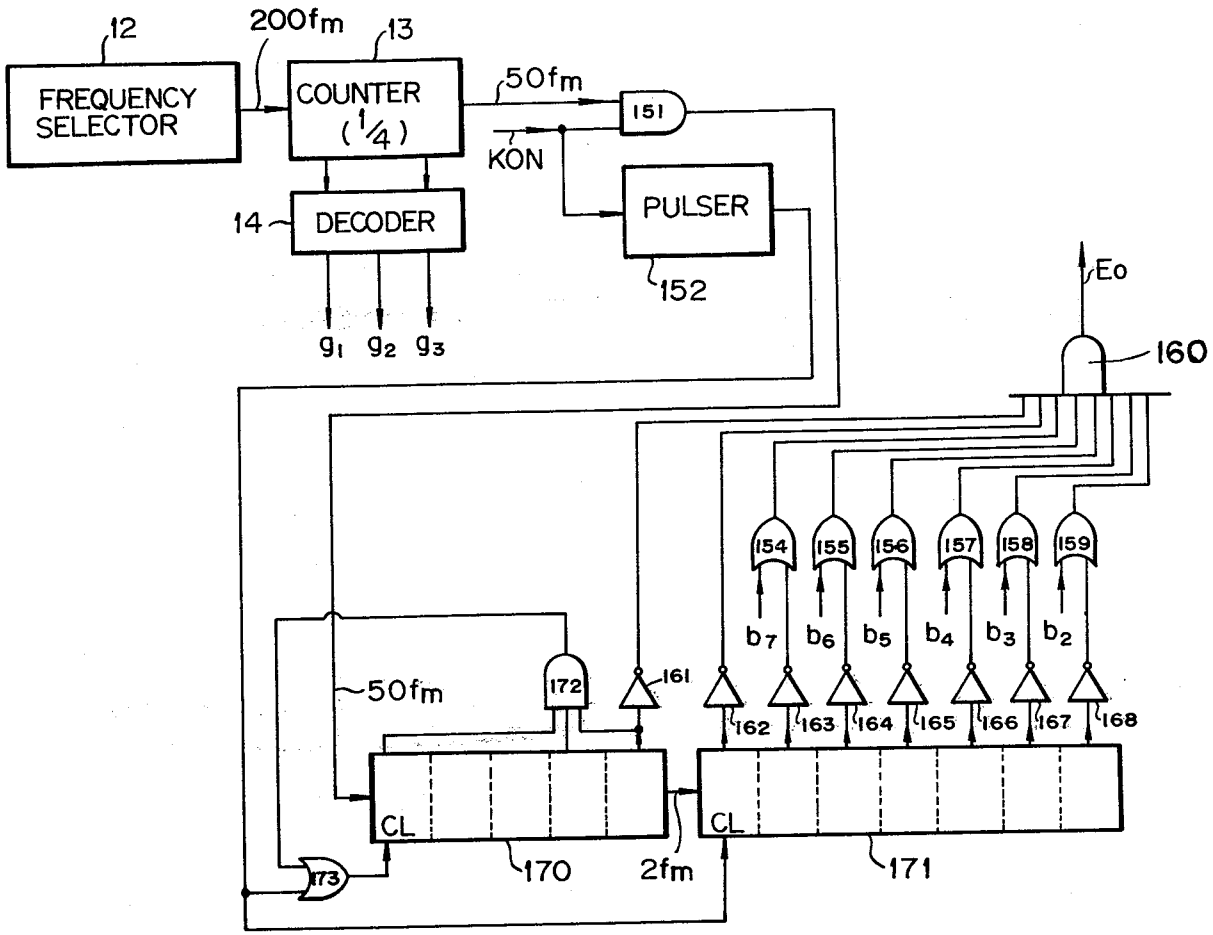
FIG. 16 shows a schematic block diagram of another embodiment of the function generator in FIG. 10.

Another embodiment of the function generator 15 will be described whereby the multipliers 24, 27 in FIG. 12 can be eliminated. FIG. 16 shows a schematic block diagram of another embodiment of the function generator 15 and the associated circuits. In FIG. 16, the same numerals that were used in FIG. 10 and FIG. 11 indicate the same or like components and need no further description, and 170, 171 correspond to the pulse counter 153 of FIG. 11. The counter 170 is a five-stage cascaded binary counter which is reset through an AND-gate 172 and an OR-gate 173 to compose a modulo twenty-five (25) counter, and the counter 171 is a seven-stage cascaded binary counter. Although the decoder 150 of FIG. 11 is not shown in FIG. 16, the signals $b_2$–$b_7$ in FIG. 16 are generated by a similar decoder. In this embodiment, the clock frequency is $50f_m$, and the pulse width of the generated waveform is $16/50f_m$ since the output of the inverter 161 is an input to the gate 160 as in FIG. 11. This width of $16/50f_m$ is wider than the width of $1/4\ f_m$ of FIGS. 4–6; and therefore, the spectrum envelope of the rectangular pulse generated by the circuit of FIG. 16 has a narrower width than those shown by FIG. 7–9. It is easy, however, to adjust this pulse width in $1/50f_m$ steps when a logic circuit unit is provided between the parallel output of the counter 170 and the input of the gate 160.

This clock frequency of $50f_m$ is used as the sampling period, or $$\Delta t=1/50f_m \quad (41)$$

When the coefficient k in equation (3) is set at $$k=1/2^{(10-n)} \quad (81)$$

$2\pi f_c=1/L=k/\Delta t=50f_m/2^{(10-n)}=(50/8)f_O$, and therefore, $f_c/f_O=50/16\pi=0.995$, which is very near to unity. And since the coefficient k is determined by equation (81), the multipliers 24, 27 in FIG. 12 can be eliminated.

In the embodiment shown by FIG. 15, multiplications by the coefficients 1/R and k are performed in two steps by the two independent bit shifters 62 and 63. In general practice, a fourth coefficient $k_T=k/R=\Delta t/RC$ may be determined, and the multiplication with this fourth coefficient $k_T$ is performed by one step.

It has been described that the waveform of the generated periodic time function and the frequency response character of the elementary digital filter are the two main factors for determining the produced tone quality and that these two main factors can be independently adjusted.

In a practical design, a simple digital filter circuit composed of a single elementary digital filter shown by FIG. 12 or a cascaded-connection of two elementary digital filters shown by FIG. 12 and FIG. 15, is preferable, and therefore, important variations in the produced tone quality are to be originated in the original waveform of the generated time function.

Figure 17:
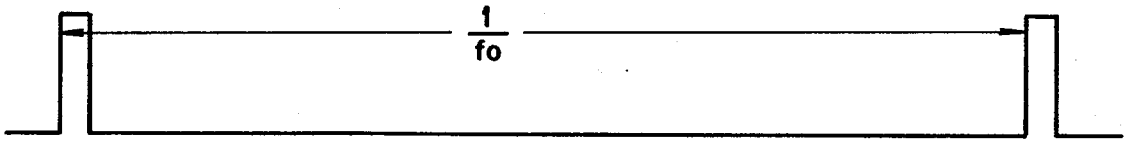
FIG. 17 shows an example of a periodic time function of frequency $f_O$ which has the same pulse width as those shown by FIG. 4, FIG. 5, and FIG. 6.
Figure 18:
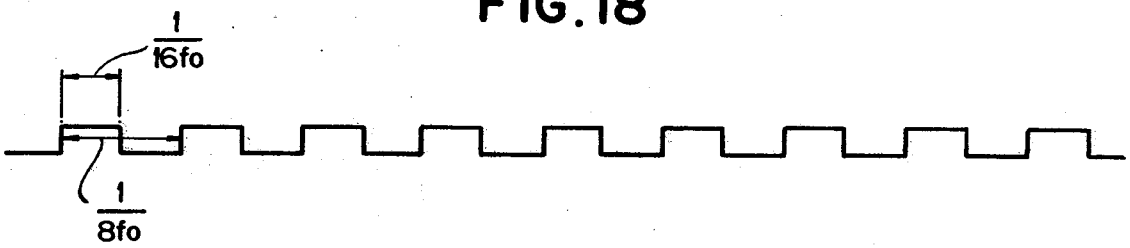
FIG. 18 shows another example of a periodic time function having a frequency of $8f_O$ and a rectangular waveform with a pulse width equal to the half cycle period.
Figure 19:
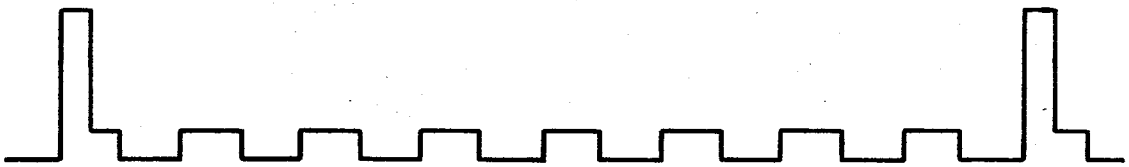
FIG. 19 shows the resultant waveform when the waveform of FIG. 18 is added to the waveform of FIG. 17.

It is easy to generate many varieties of time functions from the clock pulse train and the OCC. An example of a modified time function will be described in connection with the drawings. FIG. 17 shows an example of a periodic time function of frequency $f_o$ which is the same kind of periodic time function as is shown by FIG. 4–6. FIG. 18 shows another example of a periodic time function of frequency $8f_O$, having a rectangular waveform with a pulse-width equal to the half cycle period; and FIG. 19 shows the resultant waveform when the waveform of FIG. 18 is added to the waveform of FIG. 17. The spectrum distribution of the waveform of FIG. 19 is easily calculated from the spectrum distributions of the wavef orms of FIG. 17 and FIG. 18 which are well known, and it is easy to compose a digital circuit for producing the digital representations of the waveform shown by FIG. 19. It is clear that a waveshape having harmonic components accentuated at the frequency of $8f_O$ is produced when the waveform shown by FIG. 19 is used as the time function E for the input to the elementary digital filter shown by FIG. 12, the tuning frequency of the digital filter being set at $f_O$.

Although the invention has been described in its preferred embodiments with a certain degree of particularity, it is to be understood that the present invention is not limited to the described embodiments and their minor modifications and the various changes and modifications may be made without departing from the spirit and the scope of the invention.

I claim:

1. An electronic musical instrument comprising:

a key-status scanner means which scans the contacts of all of the key-switches on an instrument keyboard, said key-status scanner means transmitting an octave code representing the octave number corresponding to a closed contact, a note code representing one of the twelve notes corresponding to said closed contact, and a key-on signal indicating the duration of the closed state of said closed contact;

a frequency selector means controlled by said note code for generating a clock pulse train having a pulse repetition period specified by said note code;

a function generator means which receives said clock pulse train, said octave code and said key-on signal to produce a digital representation of a periodic time function for a duration determined by said key-on signal, the repetition period of said periodic time function being equal to an integral multiple of said pulse repetition period of said clock pulse train, the value of said integral multiple being determined by said octave code;

an elementary digital filter which receives said digital representation of said periodic time function, said octave code and said key-on signal for producing a digital representation of a tone waveshape, said elementary digital filter including an arithmetic logic unit for simulating a voltage and a current in an elementary analog filter; and output means for producing a musical note from the digital representation of said tone waveshape.

2. An electronic musical instrument according to claim 1 wherein said function generator means comprises:

a pulse counter means having an input terminal and parallel output terminals, said counter means being reset at the start of said key-on signal;

a gate means having first and second inputs for receiving said clock pulse train and key-on signal respectively, said gate means passing said clock pulse train to the input terminal of said counter means for a duration determined by said key-on signal; and a logic circuit unit connected to the parallel output terminals of said counter means, said logic circuit unit generating a periodic time function having a repetition period equal to an integral multiple of the pulse-repetition period of said clock pulse train, the value of said integral multiple being determined by said octave code.

3. An electronic musical instrument according to claim 2 wherein said gate means is provided with a third input for inhibiting passage of said clock pulse train to the input of said counter means during an interval in each cycle of said periodic time function, said interval being controlled by said octave code.

4. An electronic musical instrument according to claim 1 wherein said elementary digital filter comprises:

a first register for storing a first variable $V_C$;

a second register for storing a second variable I;

means for resetting said first register and said second register at the start of said key-on signal;

means for calculating an increment $\Delta V_C$ of said first variable $V_C$ during a sufficiently short sampling period $\Delta t$ in accordance with the equation $\Delta V_C = k_C I$, where $k_c$ is a first coefficient;

means for calculating an increment $\Delta I$ of said second variable I during said sampling period $\Delta t$ in accordance with the equation $\Delta I - k_L (E - V_C - IR)$, where $k_L$ is a second coefficient, R is a third coefficient and E is the periodic time function received from said function generator means;

means for adding said increments $\Delta V_C$ and $\Delta I$ to the contents of said first and second registers respectively at each sampling period $\Delta t$; and means for transmitting the content of said first register as the digital representation of said tone waveshape to said output means.

5. An electronic musical instrument according to claim 4 wherein means are provided for synchronizing the operation of said first and second registers by said clock pulse train, said sampling period being maintained equal to a desired multiple of said pulse repetition period of said clock pulse train.

6. An electronic musical instrument according to claim 4 wherein said elementary digital filter is provided with means for changing any one of said first, second and third coefficients.

7. An electronic musical instrument according to claim 4 wherein said elementary digital filter is provided with means for changing the values of said first and said second coefficients in accordance with said octave code while maintaining said sampling period $\Delta t$ constant.

8. An electronic musical instrument according to claim 4 wherein said elementary digital filter is provided with means for changing said sampling period $\Delta t$ in accordance with said octave code while maintaining the values of said first and said second coefficients constant.

9. An electronic musical instrument according to claim 4 wherein the values of said first and said second coefficient are the same.

10. An electronic musical instrument according to claim 4 wherein said means for calculating includes means for multiplying by shifting the bits representing the multiplicand when the multiplier is an integral power of two, the integer denoting the exponent being an arbitrary positive or negative number including zero.

11. An electronic musical instrument according to claim 1 wherein said elementary digital filter comprises:

a first register for storing a first variable $V_C$;

means for resetting said first register at the start of said key-on signal;

means for calculating an increment $\Delta V_C$ of said first variable $V_C$ during a sufficiently short sampling period $\Delta t$ in accordance with an equation $\Delta V_C = k_T(E - V_C)$, wherein $k_T$ is a coefficient and E is said periodic time function received from said function generator means;

means for adding said increment $\Delta V_C$ to the content of said first register at each sampling period $\Delta t$; and means for transmitting the content of said first register as the digital representation of said tone waveshape to said output means.

12. An electronic musical instrument according to claim 11 wherein means are provided for synchronizing the operation of said first register by said clock pulse train, said sampling period being maintained equal to a desired multiple of said pulse-repetition period of said clock pulse train.

13. An electronic musical instrument according to claim 11 wherein said elementary digital filter is provided with means for changing the value of said coefficient in accordance with said octave code while maintaining said sampling period $\Delta t$ constant.

14. An electronic musical instrument according to claim 11 wherein said elementary digital filter is provided with means for changing said sampling period $\Delta t$ in accordance with said octave code while maintaining the value of said coefficient constant.

15. An electronic musical instrument according to claim 11 wherein said means for calculating includes means for multiplying with said coefficient by shifting the bits representing the multiplicand when said coefficient is an integral power of two, the integer denoting the exponent being an arbitrary positive or negative number including zero.

* * * * *